US007256762B2

(12) United States Patent
Yang et al.

(10) Patent No.: US 7,256,762 B2
(45) Date of Patent: Aug. 14, 2007

(54) SWITCH FREQUENCY ADJUSTING SYSTEM AND METHOD FOR BURST MODE OF LIQUID CRYSTAL DISPLAY

(75) Inventors: Wu.Chang Yang, Tainan County (TW); Tsao-Yu Lee, Tainan County (TW); Huang Wen Sui, Tainan County (TW); Pao-Wei Cheng, Tainan County (TW); Cheng-Hsia Kuo, Tainan County (TW)

(73) Assignee: Chi Mei Optoelectronics Corp., Tainan (TW)

( * ) Notice: Subject to any disclaimer, the term of this patent is extended or adjusted under 35 U.S.C. 154(b) by 523 days.

(21) Appl. No.: 10/786,105

(22) Filed: Feb. 26, 2004

(65) Prior Publication Data

US 2004/0217715 A1 Nov. 4, 2004

(30) Foreign Application Priority Data

Feb. 27, 2003 (TW) ..... 92104214 A

(51) Int. Cl.
*G09G 3/36* (2006.01)

(52) U.S. Cl. ..... 345/102; 315/307

(58) Field of Classification Search ..... 345/102; 315/307, 209 R; 349/30, 65; 362/561; 359/238
See application file for complete search history.

(56) References Cited

U.S. PATENT DOCUMENTS 6,501,234 B2 * 12/2002 Lin et al. ..... 315/307

* cited by examiner

*Primary Examiner*—Kevin M. Nguyen
(74) *Attorney, Agent, or Firm*—Finnegan, Henderson, Farabow, Garrett & Dunner, L.L.P.

(57) ABSTRACT

The invention relates to a method for dynamically adjusting a switch frequency of a burst mode for a liquid crystal display. The method of the invention comprises the steps of: (a) receiving a scan frequency value from a signal source; (b) deriving a switch frequency value of the burst mode according to the scan frequency value; and (c) transmitting the switch frequency value to a lamp controller. According to the method of the invention, the switch frequency value can be obtained through calculation or by a look-up table. The stitch frequency value preferably equals a scan frequency value multiplied by a multiple (N+0.5), wherein N is a positive number. A tolerable range of the switch frequency value of the burst mode is ±20 Hz. The method of the invention utilizes various scan frequency values to adjust the switch frequency value. Therefore, no matter what a scan frequency value is provided by the signal source, the switch frequency value can be dynamically adjusted according to the scan frequency value so as to eliminate or decrease a water flow on the display. Thus, the eyes of people will not sense the water flow on the display.

12 Claims, 4 Drawing Sheets

SWITCH FREQUENCY ADJUSTING SYSTEM AND METHOD FOR BURST MODE OF LIQUID CRYSTAL DISPLAY

BACKGROUND OF THE INVENTION

1. Field of the Invention

The present invention relates to a switch frequency adjusting system and method, more particularly, to a dynamic switch frequency adjusting system and method for a burst mode of a liquid crystal display.

2. Description of the Related Art

A Cold Cathode Fluorescent Lamp (CCFL) is used in conventional liquid crystal displays as a backlight. The brightness of the CCFL is adjusted by switching the duty cycle of the CCFL driven by an AC source of high voltages. Referring to FIG. 1, in a liquid crystal display, a controller 11 and an inverter 12 are used to light a lamp 13 and to control the brightness of the lamp 13. The controller 11 and the inverter 12 can be combined into a module.

Referring to FIG. 2A and FIG. 2B, there are two modes to light the lamp and control the brightness of the lamp. The first mode is a continuous mode. The waveform of a control signal of the continuous mode is shown in FIG. 2A and the signal has frequencies of 30-70 KHz. The amplitude of the control signal is utilized to tune the brightness of the lamp according to the continuous mode.

The second mode is a burst mode. The waveform of a control signal of the burst mode is shown in FIG. 2B and the frequency of the control signal is also 30-70 KHz. A switch frequency of the control signal is 100-500 Hz, and the switch frequency is controlled to tune the brightness of the lamp by adjusting the duty cycle of the ON/OFF time of the control signal.

Most liquid crystal displays utilize the burst mode. The switch frequency is a certain value, and different manufacturers design the various switch frequency values. The liquid crystal display must receive a scan frequency value from a signal source so as to scan the display. The signal source could be set by a display card of a computer terminal or a software of a computer terminal. Therefore, the scan frequency value is not a fixed value. At some scan frequency values, people can see some water flow on the display. Sometimes the water flow is shifted upwardly, and sometimes the water flow is shifted downwardly. The shifting speed of the water flow is not fixed. According to experiments, the water flow is related to the scan frequency and the switch frequency.

Therefore, it is necessary to provide a dynamic switch frequency adjusting system and method for burst mode so as to solve the above problem.

SUMMARY OF THE INVENTION

One objective of the present invention is to provide a method for dynamically adjusting a switch frequency of a burst mode for a liquid crystal display. The method of the invention comprises the steps of; (a) receiving a scan frequency value from a signal source; (b) deriving a switch frequency value of the burst mode according to the scan frequency value; and (c) transmitting the switch frequency value to a lamp controller.

According to the method of the invention, the switch frequency value can be adjusted through calculation or by a look-up table. The switch frequency value preferably equals the scan frequency value multiplied by a multiple (N+0.5), wherein N is a positive number. A tolerable range of the switch frequency value of the burst mode is ±20 Hz. The method of the invention utilizes various scan frequency values to adjust the switch frequency value. Therefore, no matter what scan frequency value is provided by the signal source, the switch frequency value can be dynamically adjusted according to the scan frequency value so as to eliminate or decrease the water flow on the display. Thus, the eyes of people will not sense the water flow on the display.

DETAILED DESCRIPTION OF THE INVENTION

Figure 3:
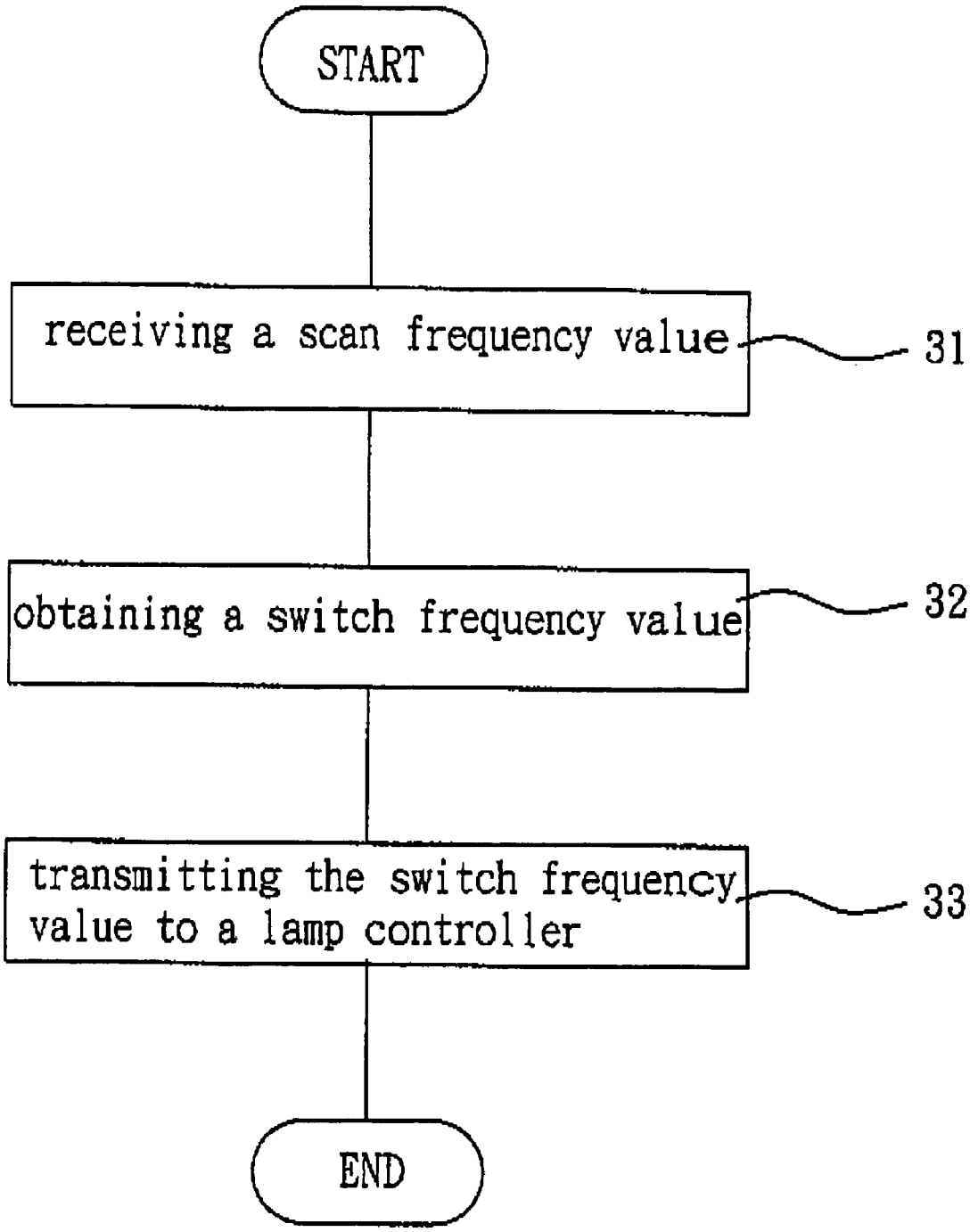
FIG. 3 is a flow chart showing a method for dynamically adjusting a switch frequency of the burst mode for a liquid crystal display, according to the invention.

Referring to FIG. 3, it shows a flow chart illustrating a method for adjusting a switch frequency of a burst mode for a liquid crystal display, according to the invention. At step 31, the liquid crystal display receives a scan frequency value from a signal source so as to scan the display. The signal source could be a display card of a computer terminal or a software of a computer terminal. Therefore, the scan frequency value is not a fixed value. According to designs of manufacturers, the scan frequency value usually is 60 Hz, 70.7 Hz, 75.03 Hz, 59.94 Hz, 72.8 Hz, 75 Hz, 56.25 Hz, 60.32 Hz, 66.67 Hz, etc.

At step 32, a switch frequency value of the burst mode is obtained by dynamically adjusting the scan frequency value. The method of the invention can utilize a calculation way to obtain the switch frequency value of the burst mode according to the scan frequency value. The switch frequency value equals the scan frequency value multiplied by a multiple (N+0.5), wherein N is a positive number. Besides, a tolerable range of the switch frequency value of the burst mode is ±20 Hz.

An example is described as follows. If the scan frequency value is 60 Hz and N=3, then, the switch frequency value is 210 Hz (i.e., 60×3.5). The tolerable range of the switch frequency value is ±20 Hz, but it preferably is ±10 Hz. Therefore, the optimum range of the switch frequency value is 210 Hz±10 Hz. That is to say, the switch frequency value can be adjusted between 200 Hz and 220 Hz according to the scan frequency value (60 Hz).

Furthermore, the switch frequency value may equal the scan frequency value multiplied by a positive number. A tolerable range of the switch frequency value of the burst mode is ±3 Hz. Another example is described as follows. The scan frequency value is 75 Hz, and the positive number is three. Then, the switch frequency value is 225 Hz (i.e., 75×3), and the tolerable range of the switch frequency value is ±3 Hz, preferably 1 Hz. Therefore, the optimum range of the switch frequency value is 225 Hz±1 Hz. That is to say, the switch frequency value can be adjusted between 224 Hz and 226 Hz according to the scan frequency value (75 Hz).

The method of the invention is not limited to the above calculation way to obtain the switch frequency value. The method of the invention can utilize a table storing a plurality of switch frequency values corresponding to scan frequency values. According to the scan frequency value, the switch frequency value is obtained from the table.

At step 33, the switch frequency value is transmitted to a lamp controller. The lamp controller transmits a control signal waveform to a lamp to light the lamp and to control the brightness of the lamp according to the switch frequency value.

According to the method of the invention, the switch frequency value is dynamically adjusted by various scan frequency values to improve the defect of the conventional, fixed switch frequency value technique. Therefore, no matter what scan frequency value is provided by the signal source, the switch frequency value can be dynamically adjusted according to the scan frequency value so as to eliminate or decrease the water flow on the display. Thus, the eyes of people will not sense the water flow.

Figure 4:
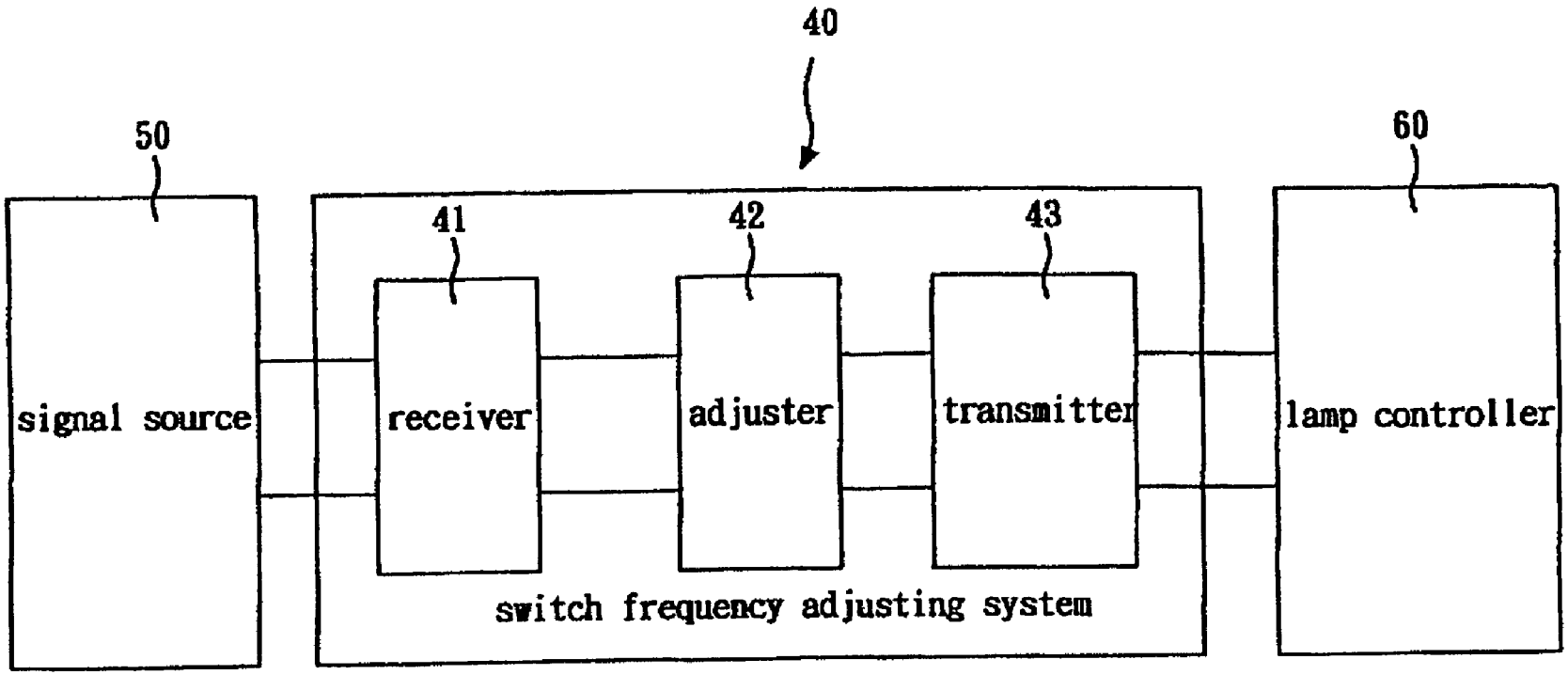
FIG. 4 is a block diagram showing a switch frequency adjusting system for the burst mode of a liquid crystal display, according to the invention.

Referring to FIG. 4, it shows a switch frequency adjusting system 40 for a burst mode of a liquid crystal display, according to the invention. The switch frequency adjusting system 40 comprises: a receiver 41, an adjuster 42 and a transmitter 43. The receiver 41 is used to receive a scan frequency value from a signal source 50. The adjuster 42 is electrically connected to the receiver 41, and dynamically adjusts a switch frequency value of the burst mode according to the scan frequency value. The transmitter 43 is electrically connected to the adjuster 42, and transmits the switch frequency value to a lamp controller 60.

The adjuster 42 comprises a frequency multiplier for deriving the switch frequency value. The switch frequency value equals the scan frequency value multiplied by a multiple (N+0.5), wherein N is a positive number. In other words, the scan frequency value is processed by the frequency multiplier to obtain the switch frequency value. A tolerable range of the switch frequency value of the burst mode is ±20 Hz.

The adjuster 42 further comprises a frequency demultiplier for deriving the switch frequency value. The switch frequency value equals the scan frequency value multiplied by a multiple (N+0.5), wherein N is a positive number. That is, the scan frequency value is processed by the frequency demultiplier and a high frequency signal to obtain the switch frequency value.

By utilizing the frequency multiplier or the frequency demultiplier of the adjuster 42, the switch frequency value can equal the scan frequency value multiplied by a positive number. A tolerable range of the switch frequency value of the burst mode is ±3 Hz.

Furthermore, the adjuster 42 further comprises a database for storing a plurality of switch frequency values corresponding to various scan frequency values. According to the scan frequency value, the switch frequency value is obtained from the database.

Figure 1:
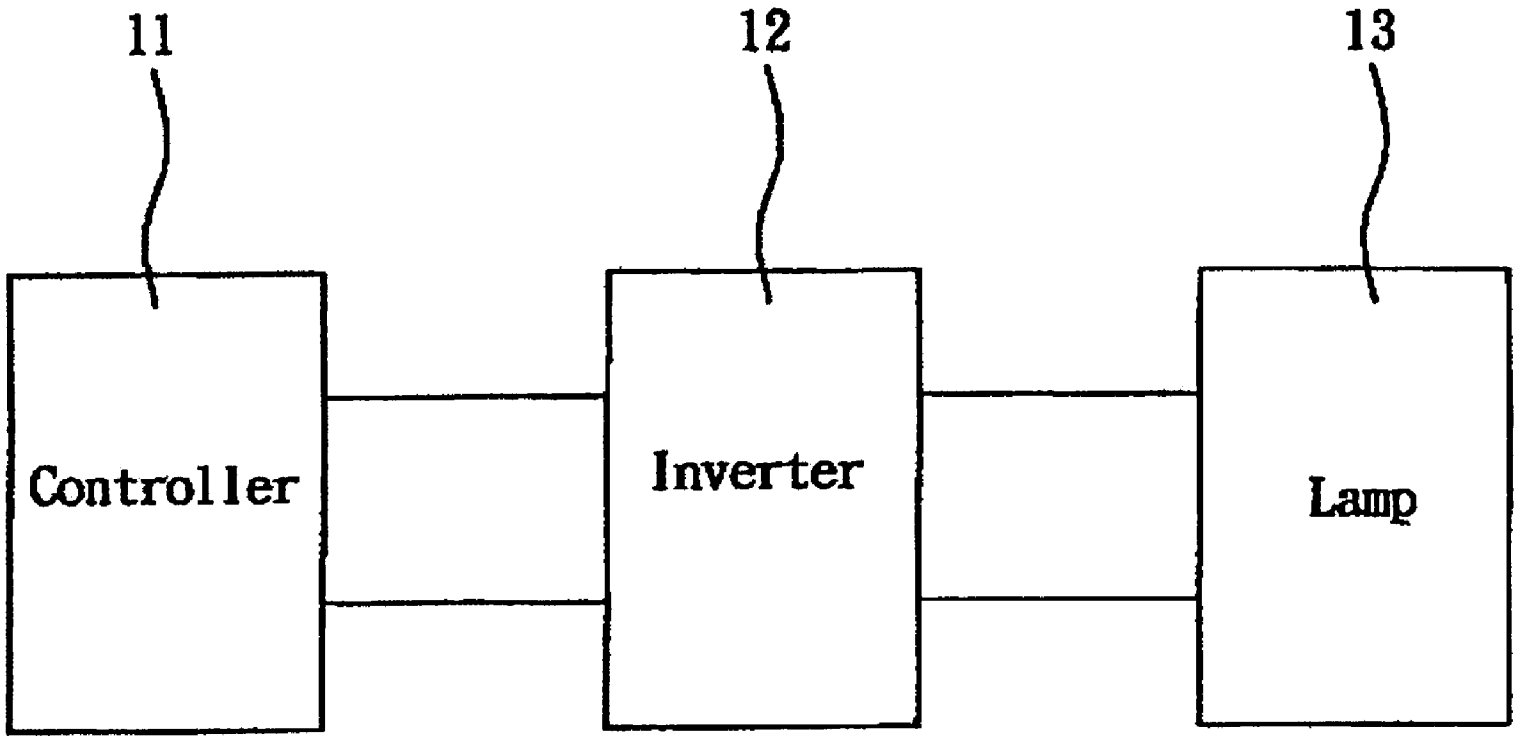
FIG. 1 is a block diagram showing a conventional control system for lighting a lamp and controlling the brightness of the lamp in a liquid crystal display.
Figure 2A:
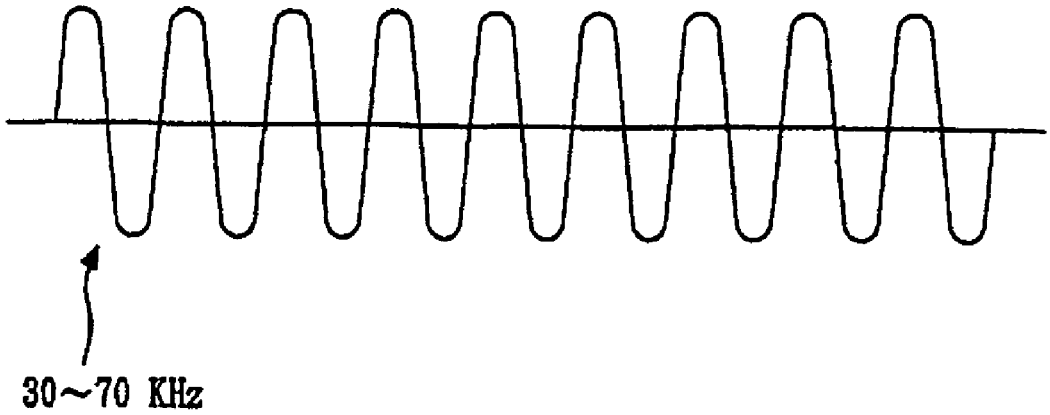
FIG. 2A is a control signal waveform of a continuous mode.
Figure 2B:
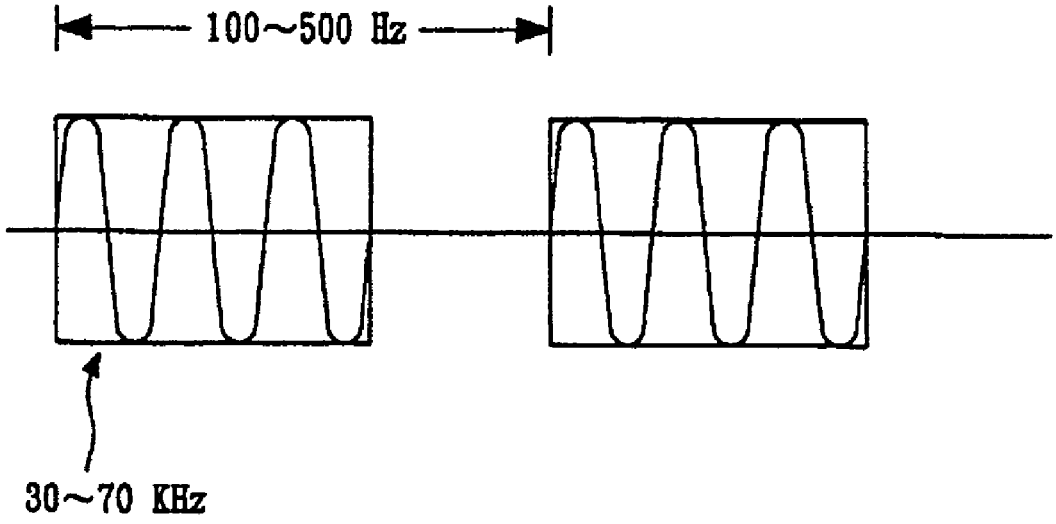
FIG. 2B is a control signal waveform of a burst mode.

After the adjuster 42 dynamically adjusts the switch frequency value, an optimum switch frequency value is obtained and is transmitted to the lamp controller 60. According to the switch frequency value, the lamp controller 60 transmits a control signal waveform to a lamp to light the lamp and to control the brightness of the lamp. Referring to FIG. 1 again, the lamp controller 60 in FIG. 4 is the same as the controller 11 in FIG. 1, and the lamp controller 60 and the inverter 12 can be combined into a module.

The switch frequency adjusting system 40 of the invention utilizes the adjuster 42 to obtain the optimum switch frequency value according various scan frequency values so as to improve the defect of the conventional, fixed switch frequency value technique. Therefore, no matter what scan frequency value is provided by the signal source, the switch frequency value can be dynamically adjusted according to the scan frequency value so as to eliminate or decrease the water flow on the display. Thus, the eyes of people will not sense the water flow.

While an embodiment of the present invention has been illustrated and described, various modifications and improvements can be made by those skilled in the art. The embodiment of the present invention is therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. A method for adjusting a switch frequency of a burst mode for a liquid crystal display, comprising the steps of:

(a) receiving a scan frequency value from a signal source;

(b) deriving a switch frequency value of the burst mode according to the scan frequency value, wherein the switch frequency value of the burst mode equals the scan frequency value multiplied by a multiple (N+0.5), wherein N is a positive number, and a tolerance range of the switch frequency value of the burst mode is less than ±20 Hz; and (c) transmitting the switch frequency value to a lamp controller.

2. The method according to claim 1, wherein at step (b), the switch frequency value of the burst mode is derived by a calculating method according to the scan frequency value.

3. The method according to claim 1, wherein a tolerable range of the switch frequency value of the burst mode is ±10 Hz.

4. The method according to claim 1, wherein at step (b), the switch frequency value of the burst mode is derived by looking up a table according to the scan frequency value.

5. A switch frequency adjusting system for a burst mode of a liquid crystal display, comprising:

a receiver for receiving a scan frequency value from a signal source;

an adjuster electrically connected to the receiver, for deriving a switch frequency value of the burst mode according to the scan frequency value, wherein the switch frequency value of the burst mode equals the scan frequency value multiplied by a multiple (N+0.5), wherein N is a positive number, and a tolerance range of the switch frequency value of the burst mode is less than ±20 Hz; and a transmitter electrically connected to the adjuster, for transmitting the switch frequency value to a lamp controller.

6. The switch frequency adjusting system according to claim 5, wherein the adjuster comprises a frequency multiplier for deriving the switch frequency value.

7. The switch frequency adjusting system according to claim 5, wherein a tolerable range of the switch frequency value of the burst mode is ±10 Hz.

8. The switch frequency adjusting system according to claim 5, wherein the adjuster comprises a frequency demultiplier for deriving the switch frequency value.

9. The switch frequency adjusting system according to claim 5, wherein a tolerable range of the switch frequency value of the burst mode is ±10 Hz.

10. The switch frequency adjusting system according to claim 5, wherein the adjuster comprises a database for storing a plurality of switch frequency values corresponding to various scan frequency values.

11. A liquid crystal display, comprising:

a liquid crystal display panel, for receiving a scan frequency value to scan the display;

at least one lamp, for providing light to the liquid crystal display;

a lamp controller, for controlling the brightness of the lamp according to a switch frequency value of a burst mode; and a switch frequency adjusting system, comprising:

a receiver for receiving a scan frequency value from a signal source;

an adjuster electrically connected to the receiver, for obtaining the switch frequency value according to the scan frequency value, wherein the switch frequency value equals the scan frequency value multiplied by a multiple (N+0.5), wherein N is a positive number, wherein a tolerable range of the switch frequency value is less than ±20 Hz; and a transmitter electrically connected to the adjuster, for transmitting the switch frequency value to the lamp controller.

12. The liquid crystal display according to claim 11, wherein the tolerable range of the switch frequency value of the burst mode is ±10 Hz.

* * * * *